US006356022B1

(12) United States Patent
Kosmahl

(10) Patent No.: US 6,356,022 B1
(45) Date of Patent: Mar. 12, 2002

(54) TAPERED TRAVELING WAVE TUBE

(75) Inventor: Henry G. Kosmahl, Westlake, OH (US)

(73) Assignee: AmpWave Tech, LLC, Cleveland, OH (US)

( * ) Notice: Subject to any disclaimer, the term of this patent is extended or adjusted under 35 U.S.C. 154(b) by 0 days.

(21) Appl. No.: 09/612,035

(22) Filed: Jul. 7, 2000

(51) Int. Cl.[7] ..... H01J 25/34
(52) U.S. Cl. ..... 315/3.5; 315/3.6
(58) Field of Search ..... 315/3.5, 3.6, 5.38, 315/5; 330/43

(56) References Cited

U.S. PATENT DOCUMENTS

| | | | | | |
|---|---|---|---|---|---|
| 3,735,188 | A | * | 5/1973 | Anderson et al. | 315/3.5 |
| 3,761,760 | A | | 9/1973 | Harper et al. | 315/3.6 |
| 3,781,588 | A | | 12/1973 | Winslow | 315/3.5 |
| 4,178,533 | A | * | 12/1979 | Ribout et al. | 315/3.6 |
| 4,296,354 | A | | 10/1981 | Neubauer | 315/3.5 |
| 4,378,512 | A | * | 3/1983 | Tsutaki | 315/3.6 |
| 4,481,444 | A | | 11/1984 | Phillips | 315/3.6 |
| 4,559,474 | A | | 12/1985 | Duret et al. | 315/3.6 |
| 4,564,787 | A | | 1/1986 | Kosmahl | 315/3.6 |
| 4,572,985 | A | * | 2/1986 | Kuntzmann et al. | 315/3.5 |
| 5,384,951 | A | * | 1/1995 | Karsten, Jr. et al. | 29/600 |
| 5,501,390 | A | | 3/1996 | Allen et al. | 228/124.1 |
| 5,723,948 | A | | 3/1998 | Yoshida | 315/3.6 |
| 5,834,971 | A | | 11/1998 | Giguere et al. | 330/43 |
| 5,959,406 | A | | 9/1999 | Hart et al. | 315/3.5 |
| 6,044,001 | A | | 3/2000 | Lee | 363/97 |

OTHER PUBLICATIONS

Electronics Engineers' Handbook; Fourth Edition; Donald Christiansen; pp. 12.43–12.51 and 17.120–17.121.
Slow–Wave Structures In Microwave Tubes; B. Epstein; Thomson–CSF Electron Tube Division; France; pp. 18.1 IEDM 84 486—489; 1984.
Advanced Communication Traveling Wave Tubes for Space Applications; Gordon A. Lange, Electron Dynamics Division, Hughes Aircraft Company; Presented to Communications Satellite Conference in 1986.

* cited by examiner

*Primary Examiner*—Don Wong
*Assistant Examiner*—Ephrem Alemu
(74) *Attorney, Agent, or Firm*—Brinks Hofer Gilson & Lione

(57) ABSTRACT

A structure to eliminate non-fundamental space harmonics in helical traveling wave tubes is disclosed. The helix radius and pitch are simultaneously varied over a short distance to improve the efficiency and performance of the tube. This new geometry, an adverse space harmonics taper (ASHT), renders the fundamental phase velocity invariant to frequency and distance effects, while adversely affecting all other space harmonics. Another aspect of the invention reduces the temperature of the helix and further improves tube efficiency, so that electronic efficiencies approach 30% in a linear performance region.

32 Claims, 3 Drawing Sheets

COMPUTED POWER TRANSFER CHARACTERISTICS FOR A TWT AMPLIFIER

TAPERED TRAVELING WAVE TUBE

FIELD OF THE INVENTION

This invention relates to helical traveling wave tubes, useful in amplifying RF signals in communications, data transmission, broadcasting, satellite and radar mapping applications. A novel geometry eliminates destructive interference within the tube, and results in significantly improved efficiency.

BACKGROUND

A traveling wave tube (TWT) is a device used to amplify an RF signal in a high vacuum environment. The RF signal is amplified by the interaction of the RF wave with a beam of electrons at high voltage. The electrons are emitted from an electron gun, a thermionic emitter of electrons, using a heater to achieve required temperatures, up to 1000° C. or more. The RF signal is typically in the range of 500 MHz to 40 GHz. A traveling wave tube used to accomplish this amplification may be of either the close-coupled cavity type or the helical type. The helical type has been favored because of its simpler construction, lower cost and large band width. Both types of amplifier, however, suffer low electronic efficiency. Other disadvantages follow from high skin effect losses, resulting in part from high helix temperatures. This typically translates into a need for greater heat transfer. High temperatures also create higher $I^2R$ losses in the helix itself, due to the simple fact that electrical resistance increases with temperature.

The need for improvement in helical tubes has been recognized and many suggestions have been made over the years. Instead of ordinary helical sections, shaped conical sections have been proposed. Varying and reducing the pitch between repeating elements of the helix have been suggested. One improvement by the inventor of the present invention, U.S. Pat. No. 4,564,787, and incorporated here by reference, involved a dynamic velocity taper, varying the pitch of the helix at an exponential rate, while keeping the helix radius constant. Many traveling wave tubes include at least one sever, generally in the center of the helix. The sever acts as a sort of isolation transformer, helping prevent backward oscillations of RF waves and preventing fluctuations in the amplifier gain. While some of these solutions have improved the situation, the state of traveling wave tubes is such that electronic conversion efficiencies still remain in the range of 10 to 25%. Overall maximum efficiencies, including significant improvements by use of a multistage depressed collector, are in the range of 40–70%.

The need for improvement is not limited merely to increasing efficiency. Heat generated by each inefficiency must be removed in order to preserve structural integrity and to minimize $I^2R$ losses. Thus, metallic heat sinks or other means of removing heat have been proposed, as have a variety of other heat-transfer devices. Manufacturers of tubes have resorted to ceramics and other materials that conduct heat but do not conduct electricity, to transfer heat from the helix itself to an outside housing and from there to outside the traveling wave tube system. These materials remain expensive and difficult to manufacture, and the problem of removing heat from the helical structure remains. What is needed is a helical traveling wave tube with inherently greater efficiency; also needed is a better means of removing the heat that is generated, minimizing losses in both the RF and the electron beam portions.

BRIEF SUMMARY

A key to increasing efficiency in a traveling wave tube is to recognize the importance of the interaction between the electron beam and the RF signal. The reason that traveling wave tubes are sometimes called "slow wave structures" is that the RF signal is traveling much faster than the generated electron beam, and the RF signal must be slowed down for interaction with, and amplification by, the electron beam. The formation of a helical path is the first step in the slowing process and is recognized as a means of lengthening the path. In one embodiment of the invention, a helical path of varying radius is used in conjunction with a helical structure of simultaneously varying pitch, forming an adverse space harmonics taper (ASHT) in part of the helix. It has been discovered that such a structure is capable of achieving far greater interaction between the RF signal and the electron beam, and thus achieving greater electronic efficiency in the amplification, and greater efficiency overall in the performance of a traveling wave tube.

One embodiment of the invention is a helical traveling wave tube, which includes a helical conductor with an RF input and an RF output, and an electron gun positioned concentrically with respect to the helical conductor. The electron gun consists of a negatively-biased cathode and a grounded anode, both at a near end of the helical conductor. There may also be a control grid downstream of the anode, still at the near end, and a collector at the far end of the helical conductor. The electron gun may be run in a DC mode or may be pulsed as desired through the cathode or the grid. A series of magnets surrounds the outside of the helical tube, for a magnetic field to focus the beam of electrons passing from the cathode to the collector. At least the portion of the apparatus comprising the electron gun, the helical conductor, and the RF input and output should be operated in a hard vacuum. The helical conductor has an input section corresponding to an RF input and an output section corresponding to an RF output. In a preferred embodiment, one end of the helix, the end near the RF input, is constructed with a taper in which the radius of the helix gradually decreases at the same time that the pitch of the helix decreases, where the pitch is the distance between the turns of the helix at the same angular point. It is not necessary that this taper continue for a great length. A satisfactory adverse space harmonics taper (ASHT) can be obtained with as few as three to five turns in the input section of the helical traveling wave tube to be effective. In a preferred embodiment, a dynamic velocity taper, in which the helical conductor has a constant radius and an exponentially varying pitch, may be placed near the output section of the helical conductor.

DETAILED DESCRIPTION OF THE INVENTION

Figure 1:
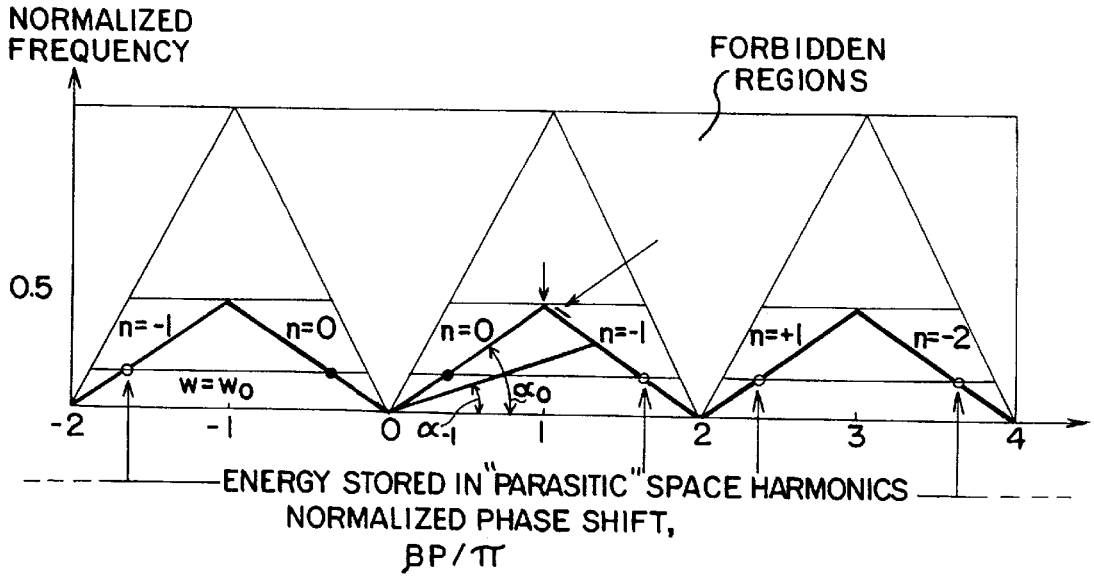
FIG. 1 is a modified Brillouin diagram.

Traveling wave tubes are used to amplify RF signals in a variety of applications. One very significant application of such tubes is in satellites, where traveling wave tubes are used for communications, data processing, broadcasting, mapping, and similar applications. The growing volume in all satellite applications now demands an increase in efficiency or an increase in the number of satellites. Increasing the efficiency of traveling wave tubes would thus result in lower cost (fewer satellites) as well as better performance. Improvements have been made to traveling wave tubes since they were first introduced in 1945, but a central problem remains: electronic efficiency, $\eta_2$, the interaction between a very low intensity RF signal and an electron beam, continues to be only between 10 and 25%.

In order to achieve interaction between the RF signal and its electron beam amplifier, the two must approach each other in velocity. The present invention retains many of the advantages of the basic helical structure of the traveling wave tube. The RF signal, traveling at close to the speed of light, must be slowed down to match the electron beam, traveling at about 10 to 50% of the speed of light. With a helix, the RF signal travels along the helix, roughly approximating a circular path, while the electron beam need travel only one pitch of the helix, a much shorter path. Many efforts have been expended over the past 55 years to achieve incremental gains in efficiency. The present invention, however, achieves a much greater gain as a result of examining fundamental aspects of the helical geometry. The invention improves on this geometry to achieve significantly greater electronic efficiency. The invention also extends the advantage of greater efficiency by an improved method of heat transfer from the helix.

The requirement for amplifying signals of radio frequency in the tube is virtual synchronicity between the velocity of the electron beam, $u_0$, and that of the slow wave on the helix, $v_0$. In practical terms, they must be traveling within a few percent of the same speed. The "slow wave" on the helix moves with velocity $v_0$. It is useful to express this velocity by a propagation constant $\beta_0=\omega_0/v_0$, where $\omega$ is the angular frequency of the RF signal. Under these circumstances, the wave propagates along the length of the helix. Its velocity is $v_0=c_0p/2\Pi a$, where $c_0$ is the speed of light, a is the radius of the helix, and p is the pitch of the helix. In this invention, the helix is wound with a variable pitch p(z), which varies in the direction of propagation along the helix, the z axis, while simultaneously varying the radius a(z) of the helix, which also varies as a function its propagation along the z axis, such that $$\frac{p(z)}{a(z)} = \frac{p_0}{a_0},$$

where $p_0$ and $a_0$ are the pitch and radius of the helix main body.

Under these conditions, the velocity $v_0$ does not vary over the frequency range for the length of the ASHT section. In particular, the propagation constant $\beta_0$ is constant for the fundamental mode and $\beta_0$ is invariant along the length of the helix. However, for all the other harmonics with phase velocities $v_n$ ($n\neq0$), the propagation constants $\beta_n$ are equal to $\omega_0/v_n$. The propagation constants $\beta_n$ are very strongly affected, where $\beta_n=\beta_0+2\Pi n/p$. This includes the principal backward wave harmonic, where n=−1. It can also be seen that the pitch/taper relationship is a simple linear one, and it will be recognized that there are an infinity of solutions that will satisfy the requirements for simultaneously varying both the pitch and the radius of the helical conductor.

When an RF signal is introduced into the helix at a frequency $\omega_0$, an RF magnetic field is established inside and outside the helix. Using a cylindrical coordinate system with r, $\Theta$, and z, corresponding RF magnetic and electrical fields are also established according to Maxwell's equations, summarized respectively as $$\text{curl } H = \varepsilon\frac{\partial E}{\partial t} + j$$

and $$\text{curl } E = -\mu_0\frac{\partial H}{\partial t},$$

where $\in$ is the dielectric constant, j is the current density into the helix, and $\mu_0$ is the permeability of the dielectric material.

The basic requirement is that the tangential components of E and H just inside and just outside the helix radius a are continuous, that is $$E_z^i=E_z^o,\ E_\Theta^i=E_\Theta^o,\ H_z^i=H_z^o,\ \text{and } H_\Theta^i=H_\Theta^o,$$

where i and o designate inside and outside, respectively. An unconditional mathematical consequence of this requirement is that the established propagating wave at frequency $\omega_0$ is composed of an infinite set of space harmonics with propagation constants $\beta_n=\omega_0/v_n$, all having the same group velocity $g_0$, but different phase velocities $v_n$, such that $\beta_n=\beta_0+2\Pi n/p$, where n are integers from $-\infty$ to $+\infty$, and $\beta_0=\omega_0/v_0$ is the propagation constant for the fundamental wave. Thus, the largest and most important components for the RF field $E_z$ (r, $\Theta$, z) and $H_z$ (r, $\Theta$, z) may be written as $$\begin{Bmatrix} E_z(r,\Theta,z) \\ H_z(r,\Theta,z) \end{Bmatrix} = e^{-i\beta_0 z}\sum_{n=-\infty}^{n=+\infty}\begin{Bmatrix} An \\ Bn \end{Bmatrix} e^{-i2\pi nz/p} I_n(y_n r)e^{in\Theta}$$

where $I_n$ is the modified Bessel function of argument ($\gamma_n$ r), and $\gamma_n=(\beta_n^2-k^2)^{0.5}$, where $\beta_n$ is the propagation constant of the nth mode, and k is the free wave propagation constant. The point here is that energy input into the traveling wave tube amplifier is necessarily deposited in these harmonics, rather than completely directed to the desired fundamental wave, which will next be quantified.

The situation is depicted in FIG. 1, a Brillouin or normalized $\omega$-$\beta$ diagram for the helix. The normalized frequency is plotted against the normalized phase shift for all modes. The branches designated as n=0, ±1, ±2, . . . describe the presence of space harmonics for the fundamental frequency $\omega_0$. The intersection of the line $\omega_0$ with the± n branches indicate that in order to excite the desired n =0 fundamental space harmonic, it is inevitable that all other space harmonics are excited and that energy is undesirably stored in them. The amount of this undesirable energy, $W_n$, is approximately equal to the "useful" desirable energy available for amplification of the RF signal, $W_0$. Eliminating these modes can be achieved by optimizing the location and shape of an adverse space harmonics taper in the input section of a helical traveling wave tube.

The stored electrical energy per period is equal to $$W = \frac{\varepsilon}{2}\sum_{n=0}^{\infty} E_{zn}^2 = \frac{\varepsilon}{2}\left(E_{z0}^2 + \sum_{n\neq 0} E_{zn}^2\right) = W_0 + W_n$$

where $E_{z0}$ is the longitudinal electric field magnitude of the fundamental space harmonic on the z-axis, $E_{zn}$ is the longitudinal electric field magnitude of the nth order space harmonic on the z-axis, and where $W_0$ is approximately equal to $W_n$. The adverse space harmonics taper of this invention reduces all electric field components for which n∞0, thereby bringing $W_n$ to almost zero energy. The energy previously stored in modes $W_n$ is thereby available for enhancement of the fundamental, $W_0$. If the energy previously "wasted" is approximately equal to the useful energy, then there is potential for almost doubling the interaction impedance of an amplifier.

Another way to make this point is that the impedance of the tube for the fundamental wave could be doubled with a beneficial effect. The impedance of the fundamental, $K_0$, is equal to $E_{z0}^2/(2\beta_0^2\, v_g\, W_0/L)$, where $E_{z0}$ is the longitudinal electric field magnitude as defined above, $\beta_0$ is the propagation constant for the fundamental mode, $v_g$ is the group velocity for all space harmonics of the system, and $W_0/L$ is the energy available per period of the helix to the fundamental mode. In order to accomplish this doubling, the electric field magnitude for the fundamental harmonic, $E_{z0}$, should be optimized. If efficiency goes as the cube root of impedance, then a doubling of the impedance would yield an improvement of about 1.26 (cube root of 2) in efficiency. With state-of-the art tubes yielding at best about 25% electronic efficiency, this invention could thus approach 30% electronic efficiency, $\eta_e$, in amplifying an RF signal. The gain in such a system would be measurable in one way by comparing the electric fields available, and minimizing the energy available to non-fundamental space modes. One such function requiring minimization in order to achieve optimal gain for the fundamental mode is $$10\log\frac{E_z(z)^2}{E_0(z)^2} = 20\log\frac{E_z(z)}{E_0(z)}.$$

The advantage of the adverse space harmonics taper may be understood in two ways. One embodiment of the invention, as noted above, is that the fundamental phase velocity $v_0$ remains constant, invariant to frequency and distance changes for the forward wave but producing substantial destructive effects on all other space harmonics. In other words, the undesirable backward wave oscillations (BWO) are suppressed. In particular, it was hypothesized that the phase velocity of the first backward space harmonic was given by the equation $$\frac{c_0}{v_{-1}} = \frac{\lambda}{p} - \frac{2\pi a}{p} \qquad \text{(Eq. 1)}$$

where $c_0$ is the speed of light, $v_{-1}$ is the velocity of the first backward harmonic, $\lambda$ is the free space wavelength, p is the pitch of the helix and a is the radius of the helix.

This equation may also be written in terms of the angular frequency $\omega$, $$\omega = c_0/a - (pc_0/2\Pi a)\cdot\beta_{-1} \qquad \text{(Eq. 2)}$$

where $\beta_{-1}=\omega/v_{-1}$. It is clear that the first term on the right in Eq. 1 will vary continuously with wavelength (or frequency) as well as the pitch of the helix. An oscillation $\omega_{osc}$, whose frequency equals $c_0/2a$, will also vary continuously. Thus, it is seen that while amplification takes place relatively smoothly, the phase velocity of the harmonics varies continuously. Performance could possibly be improved by using this influence on backward-wave oscillations to eliminate the interference and achieve greater positive amplification of the fundamental frequency. The second term suggests a structure whose pitch and radius vary simultaneously. However, in the past it was suggested that these theories be implemented by continuously varying the dielectric loading of a uniform helix, or by using two uniform helix sections with different diameters but with the same ratio pitch/radius.

Figure 2:
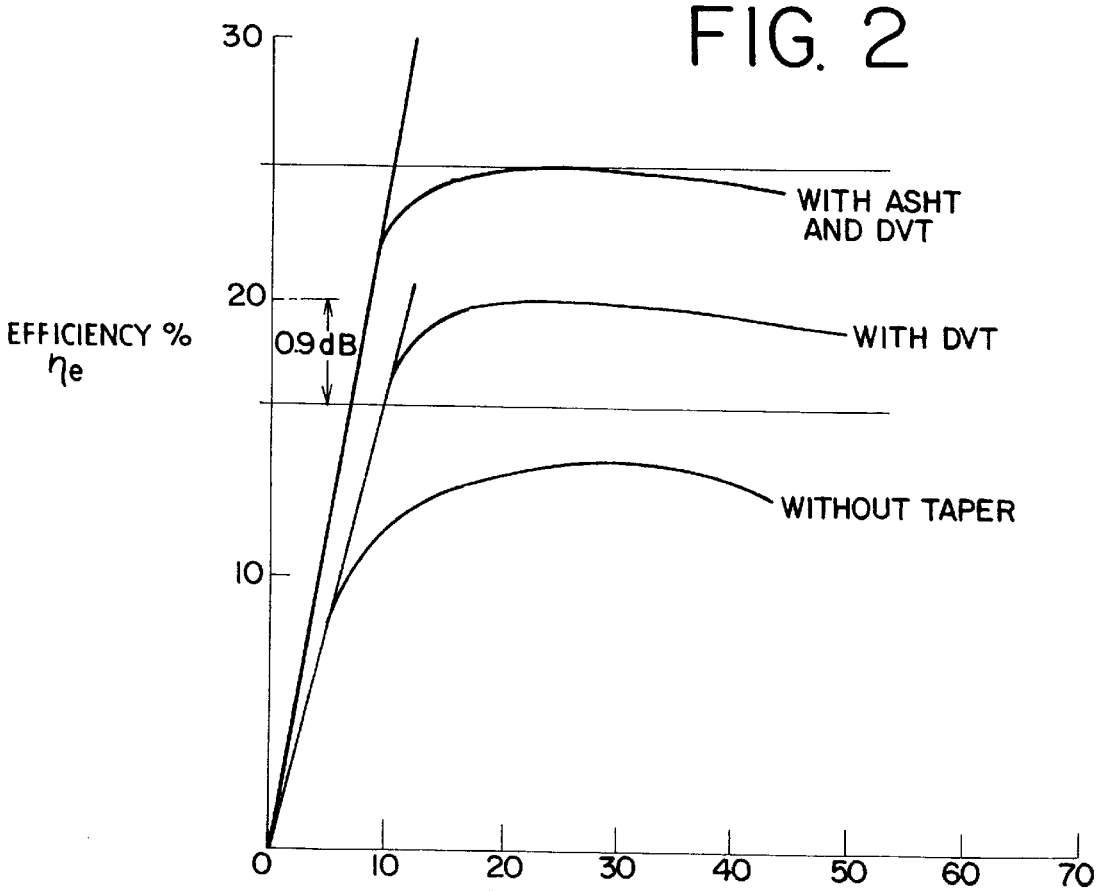
FIG. 2 is a graph of the performance of traveling wave tubes.

FIG. 2 is a graph of the gain characteristics of traveling wave tubes. As energy is extracted from the electron beam to amplify the RF signal, the beam slows down. A conventional tube has low electronic efficiency, $\eta_e$. A tube having a helical conductor with a dynamic velocity taper (DVT) shows an improvement by its higher electronic efficiency. A traveling wave tube of the present invention, with an ASHT, shows a steeper slope on such a graph, indicating its effectiveness at low power inputs, as well as significant improvements over tubes of conventional design.

Further analysis of the fundamentals of the RF circuit and the amplification of RF signals reveals that geometric effects in the helical traveling wave tube may be used for suppression of undesired harmonics of the fundamental, not merely for destructive interference. In one embodiment of the invention, an improved helical traveling wave tube suppresses the storing of electrical energy in all space harmonics of order higher than zero. It can be shown that in any periodic helix, a solution of Maxwell's equations will contain an infinity of partial waves of identical frequency, i.e., $\omega_0$. As a consequence of the mathematics of the situation, RF energy will be stored in all space harmonics, including the only one of interest to a user of the amplifier, the fundamental of order zero. Energy stored in higher order space harmonics is frequently not sufficient to produce undesirable backward wave oscillations, but does reduce energy available to the fundamental. It may be shown that about one-half of the total energy input of the amplifier is stored in the non-fundamental, n∞0, space harmonics.

Figure 3:
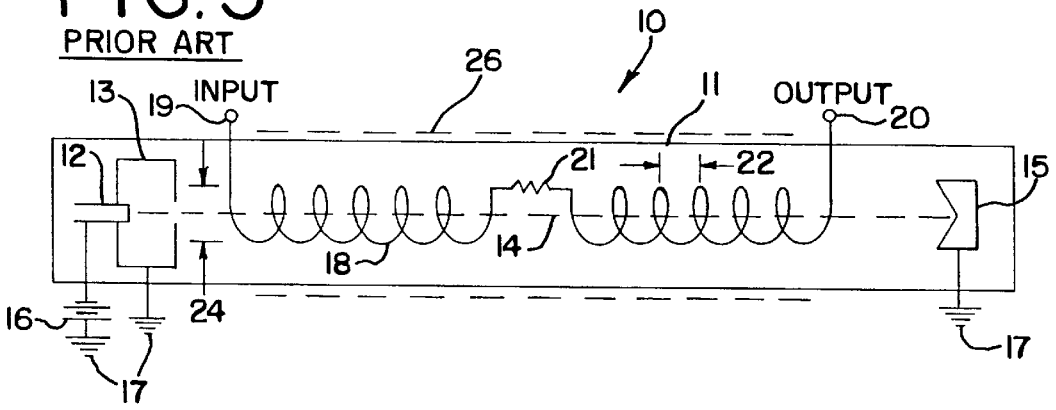
FIG. 3 PRIOR ART
FIG. 3 is a side view of a conventional helical traveling wave tube.

FIG. 3 represents a conventional helical traveling wave tube 10, in which it is understood that the working parts of the tube are contained in a housing 11 and are in a hard vacuum, typically at least $10^{-6}$ Torr. An electron gun is present, comprising a cathode 12 connected to the negative end of a source 16 of DC power. The gun also comprises an anode 13, with both the anode and the positive of the power source connected to ground 17. A beam of electrons 14 from the gun is accelerated from the cathode to the anode, down the length of the helical conductor 18 and is received by a collector 15, also grounded. An RF signal is input through an input connector 19, propagates along the helix, and exits at an output connector 20. The helix may have one or more severs 21 at locations intermediate in its length. The pitch 22 is constant through the windings of the helix, as is the diameter 24 of the helix. Magnets 26 focus the beam of electrons as they traverse the tube.

Figure 4:
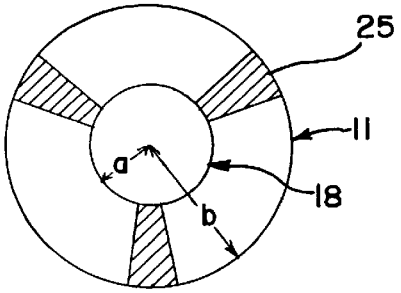
FIG. 4 PRIOR ART
FIG. 4 is a cross section of a conventional helical traveling wave tube.

FIG. 4 shows a cross-section of a conventional helical traveling wave tube, in which the helix 18 has one or more support rods 25 interposed between the helix and the outer shell or housing 11. In addition to mechanical support, these rods may provide the principal means of heat transfer between the helix and the housing, and from there to the external environment of the traveling wave tube. Typically, helix temperatures are in the range of 200– 300° C. This temperature is below that required for effective radiative heat transfer, and in the vacuum of the tube there can be no convection. Thus, the rods provide the only heat transfer possible from the heat-generating helix, i.e., the conduction of heat between the helix and the housing, which is the interface between the traveling wave tube and the outside environment.

Figure 5:
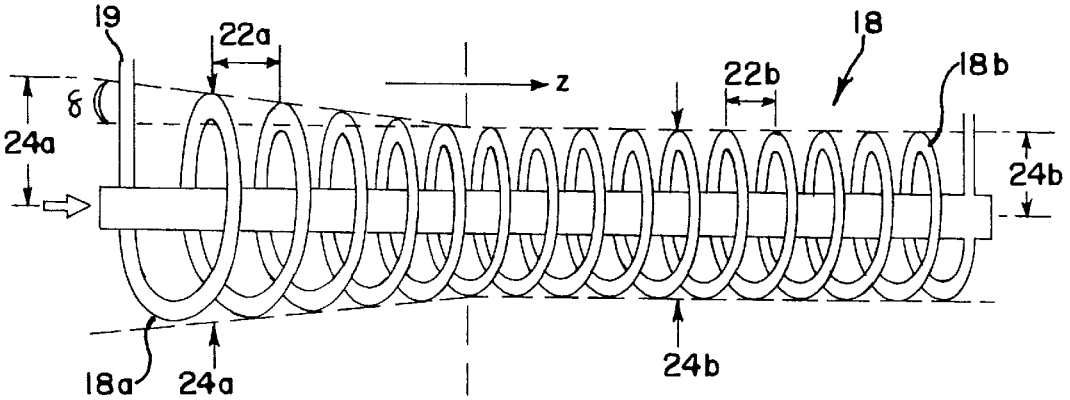
FIG. 5 is a side view of a helical traveling wave tube according to the present invention.
Figure 6:
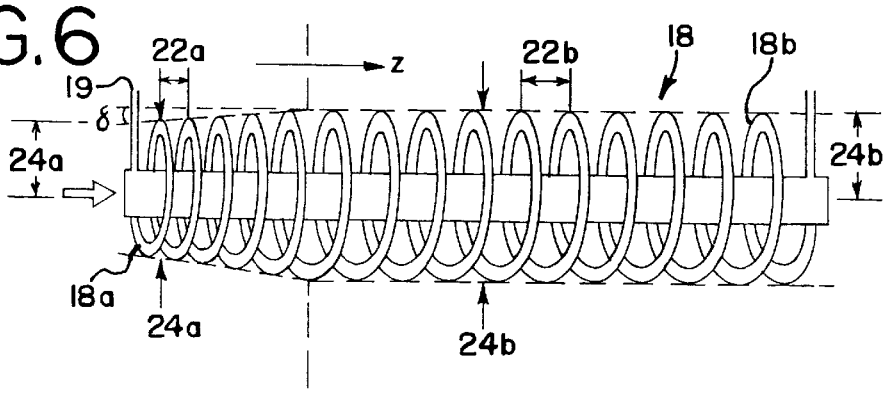
FIG. 6 is a side view of a second embodiment of a helical traveling wave tube according to the present invention.

FIGS. 5 and 6 illustrate portions of helical tubes according to the present invention and depict their structure. FIG. 5 represents a traveling wave tube with an input cone of decreasing pitch and helical radius, while FIG. 6 represents a tube with an input cone of increasing pitch and helical radius. In FIG. 5, a helix 18 is shown with a conical input section 18*a* and a middle section 18*b*. The lines touching on both 18*a* and 18*b* represent an envelope of the helical structure, not a physical limit or structure. The structure of helix 18 is depicted as a function of its propagation along axis z, understood to be the same direction as that of the electron beam in FIG. 3. In this embodiment, input section 18*a* consists of about five turns as the helix progresses from RF input 19 to the middle section 18*b* of the helix. During these five turns, the radius 24*a* of the helix decreases linearly according to the function $$\frac{p(z)}{a(z)} = \frac{p_0}{a_0},$$

until the helix radius 24*a* is equal to that of the helix radius 24*b* in the main section 18*b* of the helix. In FIG. 5, the radius 24 a decreases in accordance with angle δ. At the same time, the pitch of the helix also decreases according to the linear function, such that the velocity of the fundamental wave is the same as in the middle section of the helix. The pitch 22*a* between turns of the conical section 18*a* decreases continuously and linearly until it is equal to the pitch 22*b* of the main section 18*b*. By simultaneously decreasing both the pitch and the radius of the helix according to a linear function, an adverse space harmonics taper (ASHT) is formed. The ASHT does not change the phase velocity of the fundamental mode of the RF signal, which remains substantially synchronous with the beam of electrons traveling through the center of the helix. The electron beam may then serve to amplify the RF signal with much greater electronic efficiency, $\eta_e$, than without an ASHT.

FIG. 6 depicts the structure for a tube in which the pitch and radius are increasing. Thus, in FIG. 6, input section 18*a*, beginning at RF input 19, is conically shaped for about five turns, during which the helical radius 24*a* of input section 18*a* increases continuously and linearly until it is equal to the helical radius 24*b* of the middle section 18*b*. Simultaneously, the pitch of the helix increases continuously and linearly from the RF input 19 until it is equal to the pitch 22*b* of the middle section 18*b*. Radius 24*a* increases in accordance with angle δ as the ASHT approaches the middle of the helix.

As discussed above, further improvements may also be made to the helical tube structure. Another aspect of the invention is a housing structure better adapted to transport heat away from the helix and to the heat sink of the outside environment. Since many traveling wave tubes operate in communications satellites in space, the outside environment may indeed present such opportunities. As shown previously in FIG. 4, the housing 11 is typically concentric with the helix 18, often with supporting rods 25 that ensure structural integrity and also furnish a conductive heat path. The limit on such heat transfer is the length and cross-section of the path from the outside of the helix to the housing, or in FIG. 4, b-a. It is clear that heat transfer could be improved if the path could be shortened and widened, or if the material used in the support rods could be made more thermally conductive. Because of electromagnetic effects, however, the housing must be maintained at an effective distance from the helix. A housing that approaches the helical coil too closely may lower the impedance of the coil and adversely affect its performance.

Figure 7:
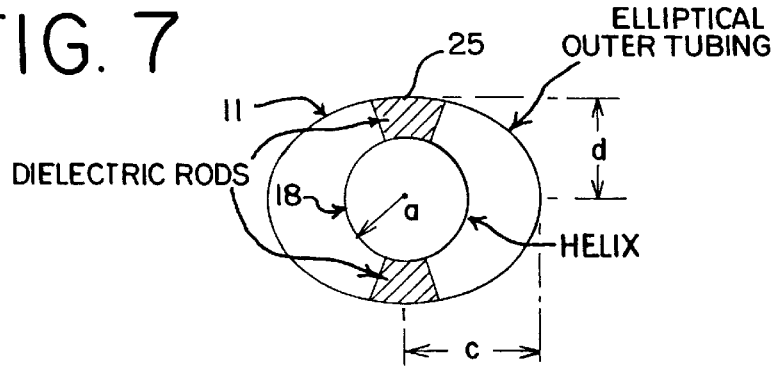
FIG. 7 is a cross section of a helical traveling wave tube according to the present invention.

In one embodiment of the invention, as depicted in FIG. 7, the housing structure 11 is still concentric with the helix 18, but is now ovate or elliptical in cross-section, rather than circular. This has the effect of bringing at least a portion of the housing closer to the helix, shortening the thermal path and increasing the heat transferred from the helix to the housing. By bringing only a portion of the housing closer to the helix, the performance of the helix is not adversely affected. It is not necessary that the ellipse be as pronounced as shown in FIG. 7. Ratios of major radius c to minor radius d may be as little as 1.05, preferably 1.10, and more preferably 1.15, to have an appreciable effect on heat transfer. Another aspect of the invention consists in altering the shapes of the support rods 25 to take advantage of the change in geometry of the housing. Thus, the rods may be made broader, allowing for a greater cross-section for heat transfer, and the length of the thermal path from the helix to the housing, d-a, in FIG. 7, is shorter than the length of b-a in FIG. 4. A close fit and good thermal contact are necessary for efficient heat transfer from the helix to the roads, and from there to the housing. With the thermal path halved, and the cross-section of the rods doubled, heat transfer may be increased by as much as a factor of four over a conventional helical traveling wave tube. The rods are desirably constructed of materials having high thermal conductivity, low electrical conductivity, and low dielectric constant. Materials that may be used include, but are not limited to, aluminum oxide, beryllium oxide, boron nitride, diamond, and silicon nitride.

In a preferred embodiment, the minor radius d in FIG. 7 is shortened to the point that the distance d-a is about half the distance b-a of FIG. 4. An example of a preferred embodiment of this geometry, useful at 32 GHz, is one in which the helical radius is 0.012 inches (0.030 cm), with a major elliptical radius of 0.030 inches (0.075 cm) and a minor elliptical radius of 0.018 inches (0.045 cm), that is, the ratios of the diameters, or the radii, is 1.0:1.5:2.5, for the basic helix radius, to the minor elliptical axis, to the major elliptical axis. It is not necessary for the housing to have the shape of a perfect ellipse. Any shape that shortens the thermal path from the helix to the housing will suffice, although housing shapes that are symmetrical and uniform are preferred. They are preferred for ease of manufacture of the housing, ease of manufacture of the support/heat transfer rods, and for symmetry of effects on the magnetic field. In another embodiment of the invention, the heat transferred from the helix has the desirable effect of lowering the temperature of the helix, in some calculations from 300° C. to 150° C. In accordance with well-known laws that relate resistance of a coil to its temperature, the skin effect losses of the helix will fall by as much as 20%.

Figure 8:
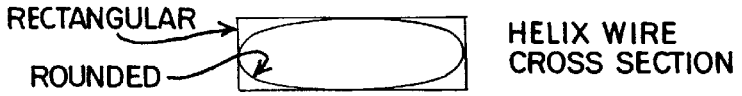
FIG. 8 is a cross section of a wire useful for a helix according to the present invention.

In another embodiment of the invention, changing the cross-sectional shape of the wire used to wind the helix, as shown in FIG. 8, lowers power losses in the helix by rounding corners in the helical conductor. As is recognized by those skilled in the art, the RF signal will travel primarily in the outer portions of the wire used to wind the helix. This is known as the "skin effect" in a conductor. The greater the frequency of the signal, the less the signal penetrates into the conductor, inversely with the square root of the frequency. "Skin effect" makes a circular wire into a less effective conductor for RF, since the external surface is minimized for a given cross-section. However, a circular wire also has the least-sharp corners. An efficient conductor of RF signals is a very thin ribbon, with a relatively large surface area and a relatively small cross-sectional area. Such wire normally is in the shape of a rectangle with an appreciable aspect ratio, and even with rounded corners rather than sharp ones, may built up great resistance because of the effect of the corners. In one embodiment of the invention, wire with an ovate or elliptical cross-section, as depicted in FIG. 8, lowers power losses in the traveling wave tube. In a preferred embodiment of the invention, the wire desirably has an elliptical cross-section in which the major diameter to minor diameter ratio is from about 1.5 to 2.0, and more preferably about 1.66. An example of a wire desirable for use at 32 GHz is tungsten-rhenium wire with a major diameter of 0.006 inches (0.015 cm) and a minor diameter of 0.003 inches (0.0076 cm). The combined effect of these improvements in heat transfer will be cumulative with those gained from the adverse space harmonics taper geometry of the input section of the helix.

Figure 9:
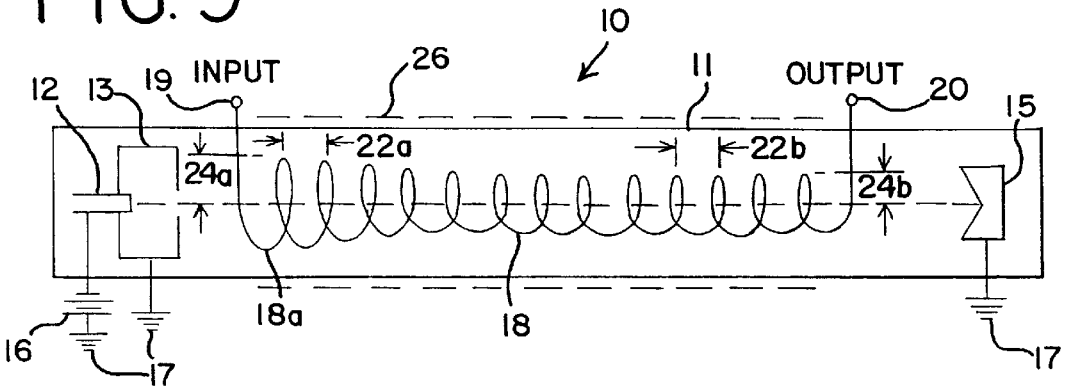
FIG. 9 is a side view of a helical traveling wave tube with a decreasing adverse harmonics space taper according to the present invention.
Figure 10:
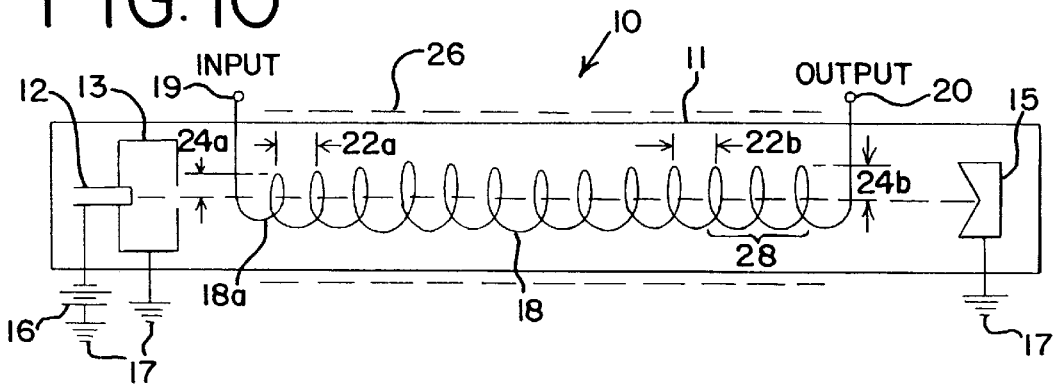
FIG. 10 is a side view of a helical traveling wave tube with an increasing adverse space harmonics taper according to the present invention, and a dynamic velocity taper.

In one embodiment of the invention, a helical tube is designed with a copper housing and anisotropic pyrolytic boron nitride (APBN) rods to provide the support and heat transfer from the helix to the copper housing. The helix, about 8 cm long, has a base radius of 0.030 cm and a pitch of 0.030 cm. A tapered section of five turns with an increase in both pitch and radius of 5% begins at about the 3 cm point, and is about 0.15 cm long. FIG. 9 illustrates another embodiment of the invention, in which the main portion of the helix is of constant pitch and radius, and the ASHT, on the input section of the helix, has decreasing pitch and radius. FIG. 10 illustrates yet another embodiment of the invention, in a manner similar to FIG. 9, but with an ASHT of increasing pitch and radius on the input side of the helix, and a dynamic velocity taper on the output side. In both FIGS. 9 and 10, a helical traveling wave tube 10 comprises a housing 11, and a helical structure 18 with an RF input 19 and an output 20. A cathode 12 emits a beam of electrons 14 through the center of the helical structure, accelerated by a grounded 17 anode 13 and collected by a collector 15, also grounded 17. Both FIGS. 9 and 10 include an ASHT near the RF input. In FIG. 9, the ASHT begins with a larger pitch 22*a* and radius 24*a*, decreasing both over three to five turns until they equal the pitch 22*b* and radius 24*b* of the middle portion of the helix. In FIG. 10, the helix pitch 22*a* and radius 24*a* of input section 18 a are smaller than that of the middle portion 18, and they become larger over a few turns until they also match the pitch 22*b* and radius 24*b* of the middle portion of the helix. The helical structure of FIG. 10 also includes a dynamic velocity taper 28 near the output section 20. Both FIGS. 9 and 10 also use magnets 26 to focus the beam of electrons as it traverses from cathode 12 to collector 15.

In one embodiment of the invention, the change in pitch and also in radius of the helix in the ASHT as it approaches the middle section is as little as about 0.5%, up to about 20%, over the length of the ASHT, of the pitch and radius respectively of the middle section. Because of the small dimensions of the helical pitch and radius, it is necessary to manufacture the helices of the present invention with reasonable manufacturing tolerances. Thus, while the increase or decrease in pitch and radius should be equal, in practice it is very difficult to achieve a ratio of 1.000. The invention may be practiced with tolerances from 0.90 to 1.10, or preferably from 0.95 to 1.05. It is very desirable to maintain the changes in pitch and radius of the helical structure at a ratio of from 0.99 to 1.01. In one embodiment of the invention, tape for a helix is wound onto a molybdenum mandrel, fired at 1500° C. and the mandrel is then etched away. Turn-to-turn outer diameters are maintained within 0.0014 in (0.036 mm) over ten turns, while the tolerance on any two consecutive turns are held within 0.0004 in (0.010 mm). Because of this need for very tight tolerances, precise methods of manufacturing must be used to achieve an adverse space harmonics taper (ASHT) on an input section of the helix. In one method, a tapered mandrel is used and wire is wound onto the mandrel in the process described above. Because the mandrel is tapered the very slight amount required for an ASHT, the finished helix has the proper taper in both helix radius (as measured in the structure's outer diameter) and pitch (as measured in turn-to-turn variations in the helix). In another method, a straight mandrel is used, and small portions of the inner or outer diameter of the helix input section are machined away to create an ASHT of three to five turns. This machining achieves the required variation in the effective radius of the helix, as measured to the center of the remaining wire. Machining may be accomplished by honing, grinding, milling, turning, or other machining methods. As will be recognized, the variable pitch for the ASHT may be incorporated into the program controlling the tape-laying machine.

It is important to recognize the fit between the helix and the rods of the support structure. As noted above, the wire that constitutes the helix must be made with a curved surface to avoid sharp corners. The wire must fit precisely with the rods that will transfer heat to the outer housing, or effective heat transfer will not occur and the temperature rise will increase skin effect losses in the traveling wave tube. Thus, in addition to any other machining, the outer diameter of the helix, or the inner portion of the rods, must be machined so that the two fit. In addition, there will be a significant variation in the radial direction of the helix, because of the ASHT. Thus, the rods must also be tapered so that the ASHT has good thermal contact through each of its turns. If the ASHT is of decreasing radius (going from larger to smaller), then the rods must taper from thinner to thicker to maintain contact. If the ASHT is of increasing radius (going from smaller to larger), the rods must go from thicker to thinner in the same direction. Alternatively, the outer diameter of the helix may be machined to a constant diameter while maintaining the shape required to form or maintain an ASHT.

While this invention has been shown and described in connection with the preferred embodiments, it is apparent that certain changes and modifications, in addition to those mentioned above, may be made from the basic features of this invention. For example, wire of tungsten-rhenium composition is desirably used to wind the helix, but other wire may be used without departing from the invention. Housings are desirably made of copper or other conductive material, but may alternately be made by other materials, so long as the property of thermal conductivity is maintained. The ASHT is preferably placed in an input section to the helical winding. However, the invention may also be practiced by additionally placing a dynamic velocity taper near the RF output of the helix. While it is preferable to use an elliptical housing to shorten the thermal path, any structure that shortens the path will enjoy those advantages of the invention. Accordingly, it is the intention of the applicants to protect all variations and modifications within the valid scope of the present invention. It is intended that the invention be defined by the following claims, including all equivalents.

I claim:

1. A helical traveling wave tube for amplifying an RF signal, comprising:

a cathode, placed at a near end of the tube;

an anode near the cathode, and operably connected to induce a beam of electrons to flow between the anode and the cathode;

a collector, placed at a far end of the tube, and constructed to receive the flow of electrons;

a helical conductor section between the cathode and the collector, said helical conductor section having an RF input, an input section, a middle section, an output section, and an RF output; and at least one magnet surrounding the helical section, operative to focus the beam of electrons, wherein the input section of the helical conductor is tapered, by simultaneously varying a pitch and a radius of the helical conductor, such that the velocity of a fundamental RF signal along the helical conductor remains substantially synchronous with the velocity of the electron beam.

2. The helical traveling wave tube of claim 1, wherein the helical conductor input section increases both pitch and radius 0.5 to 25% over the length of the input section.

3. The helical traveling wave tube of claim 1, wherein the input section increases both pitch and radius 2 to 10% over the length of the input section.

4. The helical traveling wave tube of claim 1, wherein the input section decreases both pitch and radius 0.5 to 25% over the length of the input section.

5. The helical traveling wave tube of claim 1, wherein the input section decreases both pitch and radius 2 to 10% over the length of the input section.

6. The helical traveling wave tube of claim 1, wherein the input section comprises at least three turns of the helical conductor.

7. The helical traveling wave tube of claim 1, further comprising a housing encompassing at least the helical conductor, and a support structure between the housing and the helical conductor.

8. The helical traveling wave tube of claim 7, wherein the housing comprises an ellipse, with a major diameter at least 1.05 times the minor diameter, and the support structure comprises dielectric rods having high thermal conductivity, low electrical conductivity and a low dielectric constant.

9. The traveling wave tube of claim 7, wherein the support structure further comprises rods are made from material selected from the group consisting of beryllium oxide, aluminum oxide, silicon nitride, boron nitride and diamond.

10. The helical traveling wave tube of claim 1, wherein the helical conductor output section further comprises a dynamic velocity taper, in which the helical conductor has a constant radius and an exponentially varying pitch.

11. The traveling wave tube of claim 1, wherein the helical conductor further comprises wire made of tungsten or tungsten alloys, and the wire cross-section is in a shape selected from the group consisting of a ribbon, a rounded rectangle, an ellipse, an oval and a circle.

12. The traveling wave tube of claim 1, wherein the RF signal is from 1 to 40 GHz.

13. The traveling wave tube of claim 1, wherein the helical conductor section further comprises a sever in the middle section.

14. A helical conductor for use in a traveling wave tube, comprising:

a middle section;

an input section connected to a near end of the middle section; and an output section connected to a far end of the middle section, wherein the input section is tapered by simultaneously varying a pitch and a radius of the helical conductor.

15. The helical conductor of claim 14, wherein the pitch and the radius of the input section vary linearly according to the function $$\frac{p(z)}{a(z)} = \frac{p_0}{a_0},$$

where p(z) is a pitch of the input section, which varies linearly in the direction of propagation of the helical conductor, the z-axis; $p_0$ is a pitch of the middle section; a(z) is a radius of the input section, which varies linearly in the direction of propagation of the helical conductor, the z-axis; and $a_0$ is a radius of the middle section.

16. The helical conductor of claim 14, further comprising an RF input connected to the input section, and an RF output connected to the output section.

17. The helical conductor of claim 14, wherein the input section increases in both pitch and radius 0.5 to 25% over the length of the input section.

18. The helical conductor of claim 14, wherein the input section increases in both pitch and radius 2% to 10% over the length of the input section.

19. The helical conductor of claim 14, wherein the input section decreases in both pitch and radius 0.5 to 25% over the length of the input section.

20. The helical conductor of claim 14, wherein the input section decreases in both pitch and radius 2% to 10% over the length of the input section.

21. The helical conductor of claim 14, wherein the input section comprises at least three turns of the helical conductor.

22. The helical conductor of claim 14, wherein the helical conductor further comprises a sever in the middle section.

23. The helical conductor of claim 14, wherein the output section further comprises a dynamic velocity taper.

24. A helical traveling wave tube for amplifying an RF signal by means of a beam of electrons, comprising:

a helical conductor, said helical conductor having an RF input, an input section, a middle section, an output section, and an RF output;

at least one magnet surrounding the helical conductor, operative to focus the beam of electrons;

a housing encompassing at least the helical conductor; and a support structure between the housing and the helical conductor, wherein the input section of the helical conductor is tapered, by simultaneously varying a pitch and a radius of the helical conductor, such that the velocity of a fundamental RF signal along the helical conductor remains substantially synchronous with the velocity of the electron beam.

25. The helical traveling wave tube of claim 24, wherein the input section comprises at least three turns of the helical conductor.

26. The helical traveling wave tube of claim 24, wherein the input section increases in both pitch and radius 0.5 to 25% over the length of the input section.

27. The helical traveling wave tube of claim 24, wherein the input section increases in both pitch and radius 2% to 10% over the length of the input section.

28. The helical traveling wave tube of claim 24, wherein the input section decreases in both pitch and radius 0.5 to 25% over the length of the input section.

29. The helical traveling wave tube of claim 24, wherein the input section decreases in both pitch and radius 2% to 10% over the length of the input section.

30. The helical traveling wave tube of claim 24, wherein the helical conductor middle section further comprises a dynamic velocity taper, in which the helical conductor has a constant radius and an exponentially varying pitch.

31. The helical traveling wave tube of claim 24, wherein the housing comprises an ellipse with a major diameter at least 1.05 times the minor diameter of the ellipse, and the support structure comprises dielectric rods having high thermal conductivity, low electrical conductivity and a low dielectric constant.

32. The helical traveling wave tube of claim 24, wherein the support structure further comprises rods made from material selected from the group consisting of beryllium oxide, aluminum oxide, silicon nitride, boron nitride and diamond.

* * * * *